US008733923B2

(12) United States Patent
Onishi

(10) Patent No.: US 8,733,923 B2
(45) **Date of Patent: *May 27, 2014**

(54) PRINTING DEVICE AND PRINTING METHOD

(71) Applicant: Seiko Epson Corporation, Tokyo (JP)

(72) Inventor: Hiroyuki Onishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/963,386

(22) Filed: Aug. 9, 2013

(65) Prior Publication Data

US 2013/0321510 A1 Dec. 5, 2013

Related U.S. Application Data

(63) Continuation of application No. 13/039,452, filed on Mar. 3, 2011, now Pat. No. 8,529,009.

(30) Foreign Application Priority Data

Mar. 17, 2010 (JP) ..... 2010-061262

(51) Int. Cl.
*B41J 2/01* (2006.01)
*B41J 11/00* (2006.01)
*B41J 2/21* (2006.01)

(52) U.S. Cl.
CPC ..... *B41J 11/002* (2013.01); *B41J 11/0015* (2013.01); *B41J 2/2114* (2013.01)
USPC ..... 347/102

(58) Field of Classification Search
CPC ..... B41J 11/002; B41J 11/0015; B41J 2/2114
USPC ..... 347/16, 101, 102, 104
See application file for complete search history.

(56) References Cited

U.S. PATENT DOCUMENTS

| | | | | |
|---|---|---|---|---|
| 7,794,076 | B2 | 9/2010 | Nakano et al. | |
| 8,529,009 | B2 * | 9/2013 | Onishi | 347/16 |
| 2006/0189113 | A1 | 8/2006 | Vanheusden et al. | |
| 2007/0024686 | A1 | 2/2007 | Kadomatsu et al. | |
| 2008/0213518 | A1 | 9/2008 | Oyanagi et al. | |
| 2009/0085095 | A1 | 4/2009 | Kamath et al. | |
| 2009/0225143 | A1 | 9/2009 | Fukui | |

FOREIGN PATENT DOCUMENTS

| | | | |
|---|---|---|---|
| JP | 2008-239951 | A | 10/2008 |
| JP | 2009-208348 | A | 9/2009 |
| WO | 2006/076616 | A2 | 7/2006 |
| WO | 2007/033031 | A2 | 3/2007 |
| WO | 2011/021052 | A2 | 2/2011 |

* cited by examiner

*Primary Examiner* — An Do
(74) *Attorney, Agent, or Firm* — Global IP Counselors, LLP

(57) ABSTRACT

A printing device includes a head, a radiation unit and a control unit. The head is configured to eject metallic ink including a plurality of longitudinal metal fragments onto a medium. The radiation unit is configured to irradiate the metallic ink with light to cure the metallic ink. The control unit is configured to control irradiation of the light by the radiation unit so that a film thickness formed by the metallic ink is equal to or less than a length of a long side of the longitudinal metal fragment when the metallic ink is cured on the medium.

16 Claims, 7 Drawing Sheets

PRINTING DEVICE AND PRINTING METHOD

CROSS-REFERENCE TO RELATED APPLICATIONS

This application is a continuation application of U.S. patent application Ser. No. 13/039,452 filed on Mar. 3, 2011, now U.S. Pat. No. 8,529,009. This application claims priority to Japanese Patent Application No. 2010-061262 filed on Mar. 17, 2010. The entire disclosures of U.S. patent application Ser. No. 13/039,452 and Japanese Patent Application No. 2010-061262 are hereby incorporated herein by reference.

BACKGROUND

1. Technical Field

The present invention relates to a printing device and a printing method.

2. Related Art

Inkjet printers have been developed which perform printing by ejecting metallic ink containing metal fragments onto a medium. A glossy printed product can be formed because the metal fragments reflect incident light. Since color ink is also sometimes ejected over the metallic ink, ultraviolet curable inks are used for these inks and the inks are cured by exposure to ultraviolet rays in order to prevent color mixing (see, for example, Japanese Laid-Open Patent Publication No. 2008-239951).

SUMMARY

The metal fragments of the metallic ink are scattered and distributed in irregular positions and directions within dots. When light is irradiated to cure the dots in this state, the metal fragments are fixed in a state of having been scattered within the dots. The reflected light of the metal fragments distributed with irregular orientations then heads in irregular directions, and the glossiness is no longer considerably sufficient.

The present invention was devised in view of such circumstances, and an object thereof is to increase the glossiness of ink containing metal fragments.

According to one aspect of the present invention for achieving the objects described above, a printing device includes a head, a radiation unit and a control unit. The head is configured to eject metallic ink including a plurality of longitudinal metal fragments onto a medium. The radiation unit is configured to irradiate the metallic ink with light to cure the metallic ink. The control unit is configured to control irradiation of the light by the radiation unit so that a film thickness formed by the metallic ink is equal to or less than a length of a long side of the longitudinal metal fragment when the metallic ink is cured on the medium.

Other characteristics of the present invention are made clear from the descriptions of the present specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
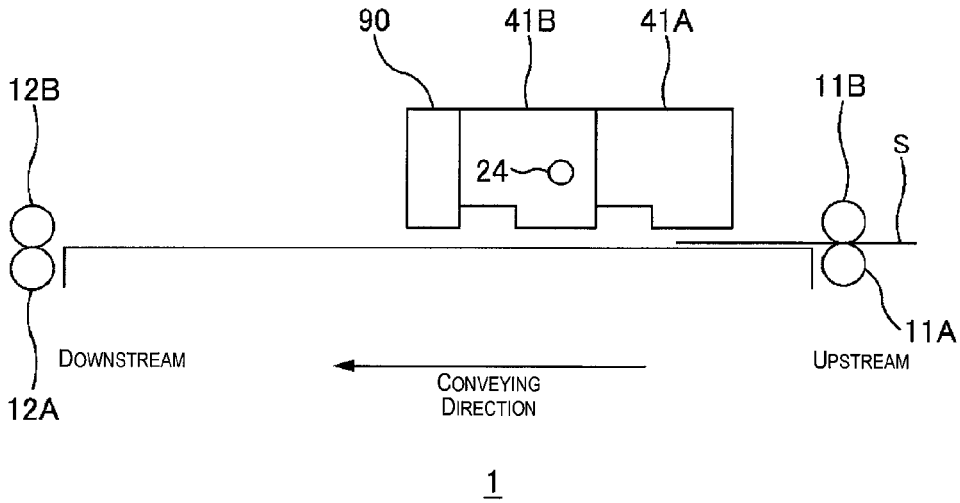
FIG. 1 is a schematic side view of a printer 1 in the present embodiment.

At least the following items are made clear from the descriptions of the present specification and the accompanying drawings.

A printing device according to an illustrated embodiment includes a nozzle for ejecting metallic ink including metal fragments onto a medium, a radiation unit for irradiating the medium with light for temporarily curing the metallic ink, and a control unit for controlling the irradiation of the light by the radiation unit so that a film thickness formed by the metallic ink is equal to or less than a length of a long side of the metal fragments when the metallic ink is temporarily cured in the medium.

This makes it possible for the glossiness of the ink containing metal fragments to be increased.

In this printing device, it is preferable that the light be irradiated onto the metallic ink deposited on the medium after a predetermined amount of time after the metallic ink has been ejected onto the medium, whereby the film thickness formed by the metallic ink is made equal to or less than the length of the long side of the metal fragments.

It is preferable that the intensity of the light irradiated onto the medium be adjusted, whereby the film thickness formed by the metallic ink is made equal to or less than the length of the long side of the metal fragments.

This makes it possible to adjust the degree of hardness of the surface of the metallic ink and to create a state in which the metal fragments in the metallic ink readily lie flat.

It is preferable that the metallic ink be an ultraviolet curable liquid and that the light include ultraviolet rays.

This makes it possible to radiate ultraviolet rays and cure the metallic ink.

It is preferable that the printing device further comprise a nozzle for ejecting drawing ink for forming an image, wherein the drawing ink for forming the image is ejected onto the metallic ink after the metallic ink has been temporarily cured so that the film thickness formed by the metallic ink is equal to or less than the length of the long side of the metal fragments.

This makes it possible to form an image with drawing ink over metallic ink that has been increased in glossiness.

It is preferable that the length of the long sides of the metal fragments be the average of the lengths of the metal fragments included in the metallic ink. It is also preferable that the film thickness e the average of the film thicknesses formed on the medium by the metallic ink.

This makes it possible to cause the metal fragments of the metallic ink to appropriately lie flat.

A printing method according to the illustrated embodiment includes: providing a nozzle for ejecting metallic ink including metal fragments onto a medium, and a radiation unit for irradiating the medium with light for temporarily curing the metallic ink; ejecting the metallic ink onto the medium; and irradiating the light so that the film thickness formed by the metallic ink is equal to or less than a length of a long side of the metal fragments when the metallic ink is temporarily cured in the medium.

This makes it possible to increase the glossiness of the ink containing the metal fragments.

Embodiments

Figure 2:
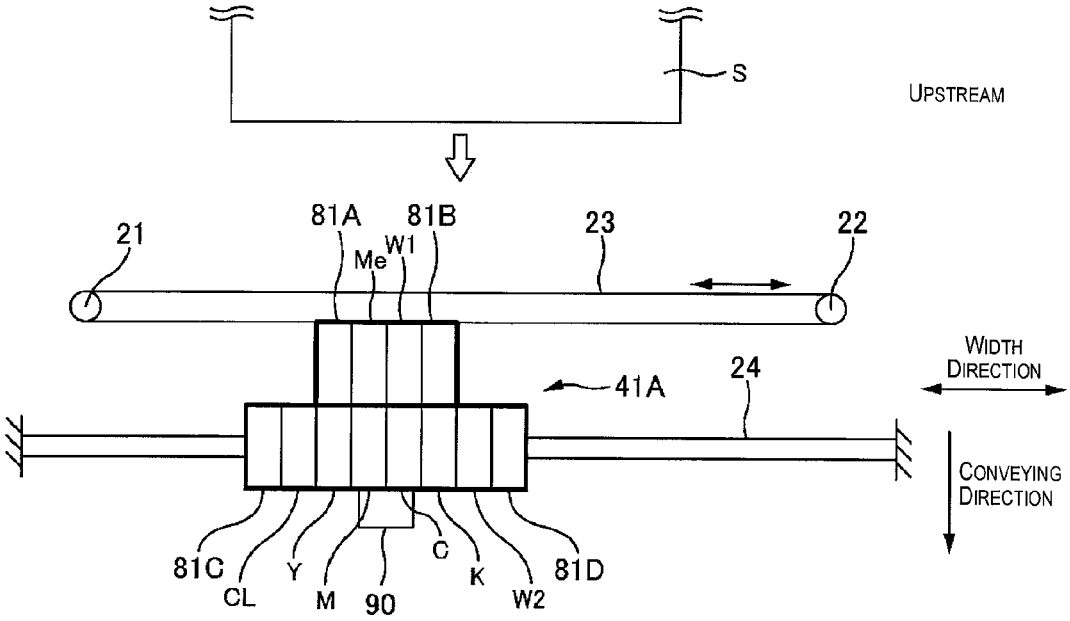
FIG. 2 is a schematic top view of the printer 1 in the present embodiment.
Figure 3:
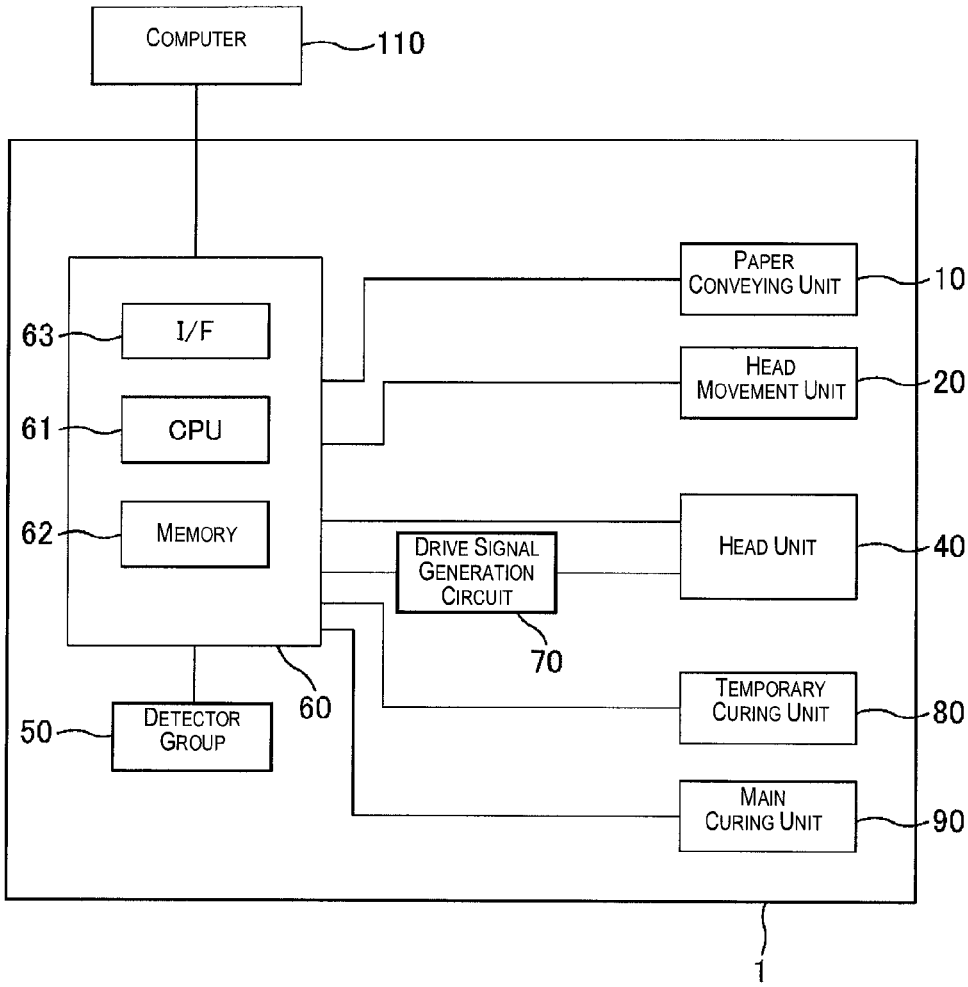
FIG. 3 is a block diagram of the printer 1 in the present embodiment.

FIG. 1 is a schematic side view of the printer 1 in the present embodiment. FIG. 2 is a schematic top view of the printer 1 in the present embodiment. FIG. 3 is a block diagram of the printer 1 in the present embodiment. The configuration of the printer 1 is described hereinbelow with reference being made to these diagrams.

FIG. 3 shows the printer 1 and the computer 110. The printer 1 comprises a paper conveying unit 10, a head movement unit 20, a head unit 40, a detector group 50, a controller 60, a drive signal generation circuit 70, a temporary curing unit 80, and a main curing unit 90.

The paper conveying unit 10 includes a conveying roller 11A, a first pressing roller 11B, a paper ejection roller 12A, and a second pressing roller 12B. The conveying roller 11A and the paper ejection roller 12A are connected to a motor (not shown), and the rotation of the motor is controlled by a controller 60. The medium is conveyed in the conveying direction by being sandwiched between the conveying roller 11A and the first pressing roller 11B. The medium is also conveyed in the conveying direction and ejected by being sandwiched between the paper ejection roller 12A and the second pressing roller 12B. In the present embodiment, the medium S is a white paper or a transparent film.

The head movement unit 20 has a function for moving a first head 41A and a second head 41B, described hereinafter, simultaneously in a head movement direction. The head movement direction is a direction that intersects the conveying direction of the medium S. After the medium S has been conveyed a predetermined amount, an operation is repeatedly performed in which ink is ejected while the first head 41A and the second head 41B are moved in the head movement direction, whereby an image can be formed over the entire surface of the medium S. In the conveying direction of the medium S, the discharging of metallic ink Me and white ink W1 is given priority over the discharging of color ink YMCK, clear ink CL, and white ink W2 as is described hereinafter. Consequently, after a background is formed by the metallic ink Me or the white ink W1, a color image and a coating can be formed over the background.

The head movement unit 20 includes a movement roller 21, a pulley 22, a belt 23, and a shaft 24. The belt 23 is installed over the movement roller 21 and the pulley 22. A motor (not shown) is attached to the movement roller 21 and is caused to rotate by the control of the controller 60, whereby the belt 23 moves in a movement direction. The belt 23 is fixed to the first head 41A. The first head 41A is fixed integrally with the second head 41B. The shaft 24 is provided so as to pass through the second head 41B, and the second head 41B is therefore capable of moving so as to slide along the shaft 24. The first head 41A is thereby moved in the head movement direction, whereby the second head 41B also moves in the head movement direction.

The head unit 40 includes two heads: the first head 41A and the second head 41B. The heads include a nozzle row for ejecting ink and a temporary curing unit for temporarily curing the ejected ink. The configuration of these heads is described hereinafter.

The detector group 50 represents various detectors for detecting information of the components of the printer 1 and send the information to the controller 60.

The controller 60 is a control unit for performing control of the printer 1. The controller 60 has a CPU 61, a memory 62, and an interface 63. The CPU 61 is a calculating processing device for performing control of the entire printer. The purpose of the memory 62 is to ensure regions for storing programs of the CPU 61, operational regions, and the like, and the memory 62 has a RAM an EEPROM, and other storage elements. The CPU 61 controls the units in accordance with the programs stored in the memory 62. The interface 63 conducts data transmission between the printer 1 and the computer 110, which is an external device.

The drive signal generation circuit 70 generates a drive signal to be applied to a piezo element or another drive element included in the head, described hereinafter, and causing ink droplets to be ejected. The drive signal generation circuit 70 includes a DAC (not shown). An analog voltage signal is then generated based on digital data pertaining to the waveform of the drive signal sent from the controller 60. The drive signal generation circuit 70 also includes an amplification circuit (not shown), the electricity is amplified in the generated voltage signal, and a drive signal is generated.

The temporary curing unit 80 temporarily cures the deposited ink (hereinafter "temporary curing" is sometimes referred to as pinning") by irradiating ultraviolet rays onto the ultraviolet curable ink deposited on the medium S. Specifically, the ink deposited on the medium S is increased in viscosity at its surface, or is cured. Thus, by increasing the viscosity of the surface of the deposited ink, when another ink is then deposited on top of this ink, the inks do not readily move against each other, and bleeding can be suppressed.

The temporary curing unit 80 includes four LED substrates 81A, 81B, 81C, 81D. The configuration of the LED substrate 81 is described hereinafter.

The main curing unit 90 is disposed farther downstream in the conveying direction, as shown in FIG. 2. The medium S is irradiated with light containing ultraviolet rays, and the inks deposited on the medium S undergo main curing. The main curing unit 90 is configured by assembling a plurality of the LED substrates 81 previously described.

Figure 4A:
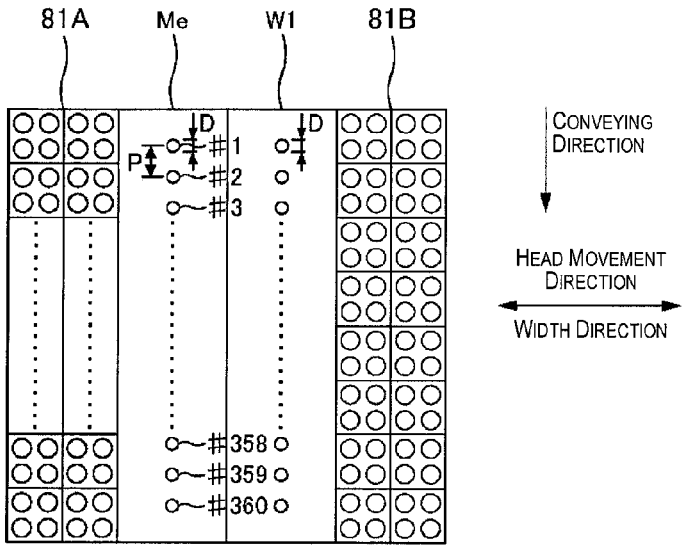
FIG. 4A is a drawing used to illustrate the configuration of a first head 41A.

FIG. 4A is a drawing used to illustrate the configuration of the first head 41A. The drawing is a top view of the first head 41A, but the nozzle holes and LEDs, which normally can only be seen from below, are depicted transparently in order to simplify the description of the nozzle arrangement and LED arrangement. The first head 41A includes the a metallic ink nozzle row Me for ejecting metallic ink, and a white ink nozzle row W1 for ejecting white ink. These nozzle rows have a nozzle pitch P of 360 dpi and include 360 nozzles, numbered 1 through 360.

The metallic ink and white ink in the present embodiment are ultraviolet curable inks that are cured by being irradiated with ultraviolet rays. The metallic ink in the present embodiment is also an ultraviolet curable ink containing a metal pigment. The metal pigment is preferably a pigment that can guarantee a high metallic glossiness. As an example, the metal pigment may be aluminum flakes composed of an aluminum alloy.

The first head 41A includes a first LED substrate 81A and a second LED substrate 81B. The LED substrates include a plurality of LEDs. These are capable of irradiating ultraviolet rays for temporary curing. With such a configuration, metallic ink or white ink can be ejected onto the intermittently conveyed medium S and the deposited ink can be irradiated with ultraviolet rays and temporarily cured, while the first head 41A moves in the head movement direction. The first LED substrate 81A and the second LED substrate 81B are not always constantly illuminated, but are illuminated so that ultraviolet rays are irradiated after a predetermined amount of time has passed following the deposition of ink on the medium, as will be described hereinafter.

Figure 4B:
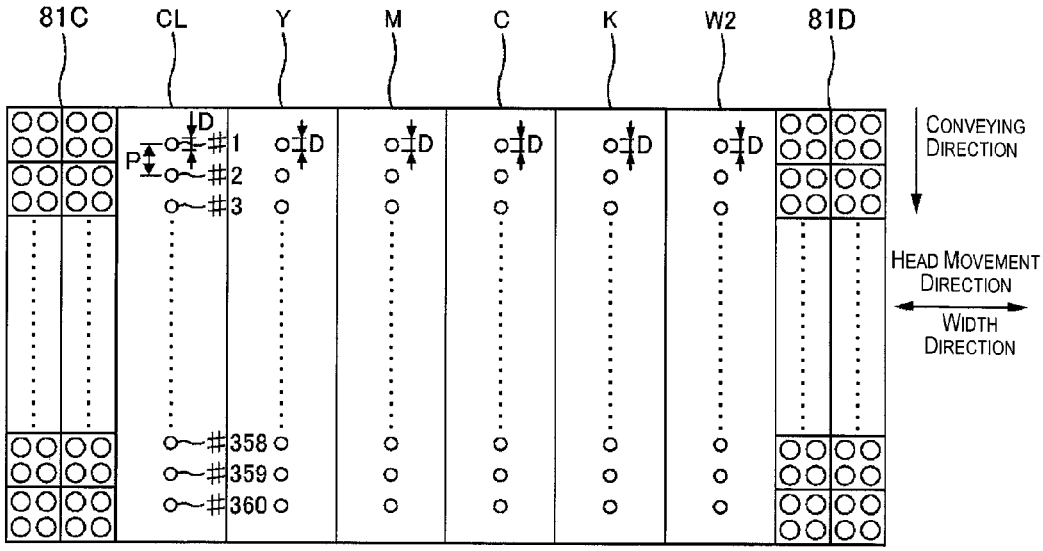
FIG. 4B is a drawing used to illustrate the configuration of a second head 41B.

FIG. 4B is a drawing used to illustrate the configuration of the second head 41B. This drawing is a top view of the second head 41B, but the nozzle holes and LEDs, which normally can only be seen from below, are depicted transparently in order to simplify the description of the nozzle arrangement and LED arrangement. The second head 41B and the first head 41A include a yellow ink nozzle row Y for ejecting yellow ink, a magenta ink nozzle row M for ejecting magenta ink, a cyan ink nozzle row C for ejecting cyan ink, and a black ink nozzle row K for ejecting black ink. The second head 41B furthermore includes a clear ink nozzle row CL for ejecting transparent clear ink, and a white ink nozzle row W2 for ejecting white ink. These nozzle rows also have a nozzle pitch P of 360 dpi and include 360 nozzles, numbered 1 through 360. These inks are all ultraviolet curable inks.

The second head 41B also includes a third LED substrate 81C and a fourth LED substrate 81D. The LED substrates include pluralities of LEDs and are capable of radiating ultraviolet rays for temporary curing. With such a configuration, the second head 41B can eject color ink or clear ink onto the medium, which is being conveyed intermittently, and can temporarily cure the deposited clear ink by raiding ultraviolet rays.

Figure 5:
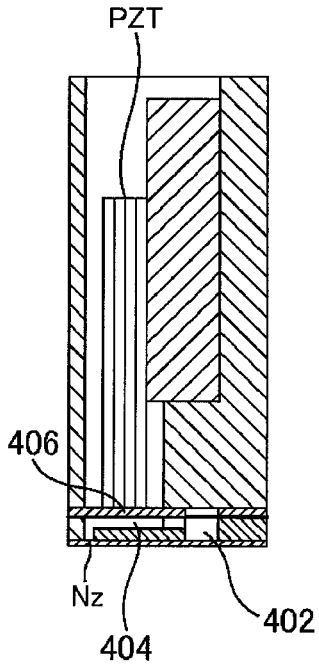
FIG. 5 is a drawing used to illustrate the structure of a head.

FIG. 5 is a drawing used to illustrate the structure of a head. This drawing shows a nozzle Nz, a piezo element PZT, an ink supply channel 402, a flow channel supply port 404 (equivalent to an ink supply port), and an elastic plate 406.

Inks are supplied to the ink supply channel 402 from an ink tank (not shown). These inks are supplied to the flow channel supply port 404. A drive pulse of a drive signal, described hereinafter, is applied to the piezo element PZT. When the drive pulse is applied, the piezo element PZT expands and contracts according to the signal of the drive pulse, and the elastic plate 406 is caused to vibrate. Ink droplets in an amount corresponding to the amplitude of the drive pulse are ejected from the nozzle Nz.

Figure 6A:
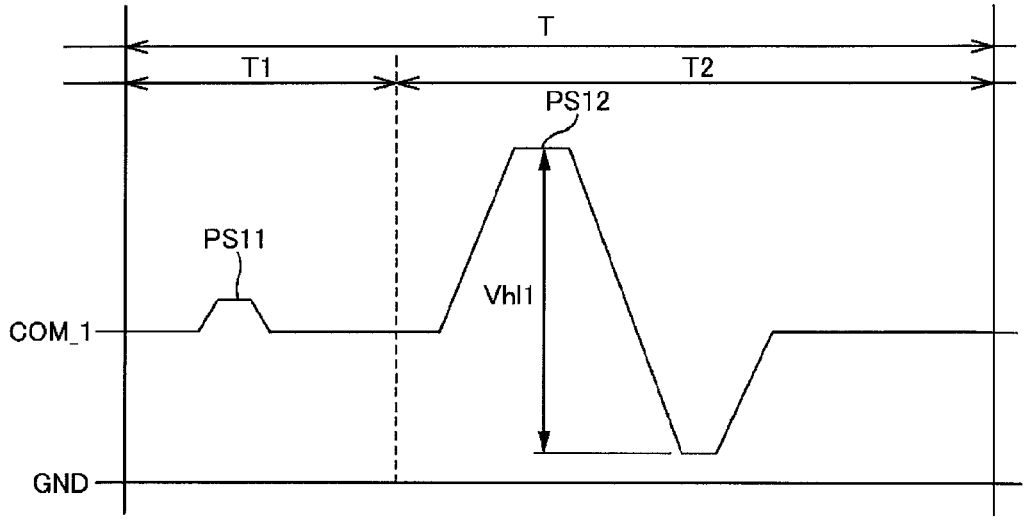
FIG. 6A is a diagram for describing an example of a first drive signal COM_1.

FIG. 6A is a diagram for describing an example of the first drive signal COM_1. The first drive signal COM_1 is a drive signal applied commonly to the piezo elements PZT of the nozzle rows of the first head 41A.

The first drive signal COM_1 is repeatedly generated at repeating cycles T. The time period T, which is a repeating cycle, corresponds to the time period it takes the head to move one pixel in the movement direction. For example, in a case in which the print resolution is 360 dpi, the time period T is equivalent to the time period it takes the head to move 1/360 of an inch in relation to the medium. A drive pulse PS12 of an interval T2 included within the time period T is applied to the piezo element PZT based on pixel data included in the print data, whereby an ink droplet is ejected into one pixel. A drive pulse PS11 is a drive signal for inducing a microvibration in the ink surface in the nozzle, and this drive pulse therefore does not cause ink to be ejected.

Figure 6B:
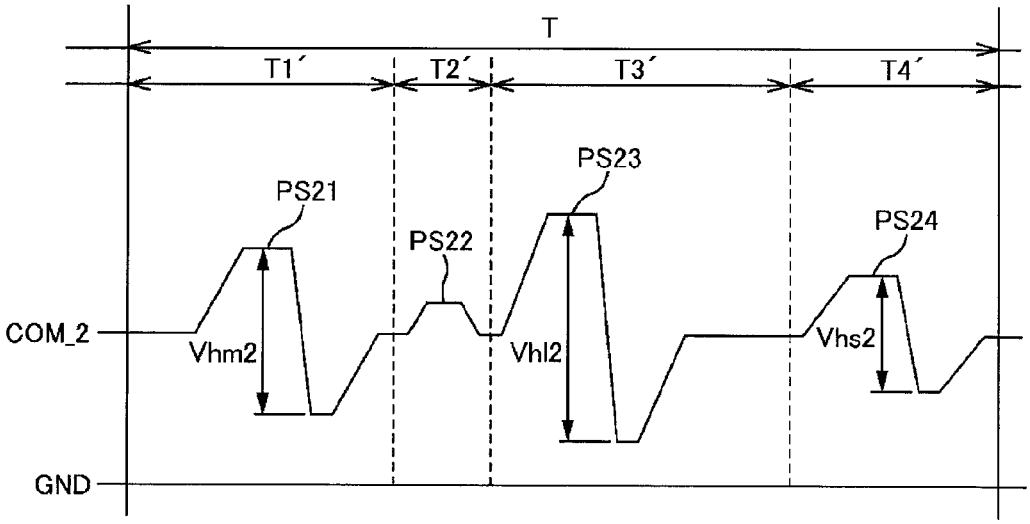
FIG. 6B is a diagram for describing an example of a second drive signal COM_2.

FIG. 6B is a diagram for describing an example of the second drive signal COM_2. The second drive signal COM_2 is a drive signal applied commonly to the piezo elements PZT of the nozzle rows of the second head 41B.

Drive pulses PS11 to PS14 of the intervals included within the time period T are applied to the piezo element PZT based on pixel data included in the print data, and ink droplets of different sizes are ejected into one pixel from the nozzles of the nozzle rows. This makes it possible to express a plurality of tones.

The second drive signal COM_2 includes a drive pulse PS21 generated in an interval T1' within the repeating cycle T, a drive pulse PS22 generated in an interval T2', a drive pulse PS23 generated in an interval T3', and a drive pulse PS24 generated in an interval T4'.

The drive pulse PS22 is a drive pulse which induces a microvibration in the ink surface in the nozzle Nz. Ink is not ejected from the nozzle Nz even when this drive pulse PS22 is applied to the piezo element PZT.

The drive pulse PS24 is a drive pulse having a voltage amplitude Vhs2. The drive pulse PS21 is a drive pulse having a voltage amplitude Vhm2. The drive pulse PS23 is a drive pulse having a voltage amplitude Vhl2. The voltage amplitudes have the size relationship Vhs2<Vhm2<Vhl2. The greater the voltage amplitude of the drive pulse, the greater the displacement of the piezo element PZT; therefore, the greater the voltage amplitude, the greater the amount of ink ejected. Specifically, the drive pulse PS24 is a drive pulse for ejecting small dots, the drive pulse PS21 is a drive pulse for ejecting medium-sized dots, and the drive pulse PS23 is a drive pulse for ejecting large dots.

In the present embodiment as described above, the first drive signal COM_1 and the second drive signal COM_2 are used, and the drive pulse PS12 of the first drive signal COM_1 is larger than the drive pulses of the second drive signal COM_2 while the cycle is also longer than that of the other drive pulses. This makes it possible for ink droplets for forming large dots to be ejected from the first head 41A. A background can then be formed by metallic ink or white ink.

Figure 7:
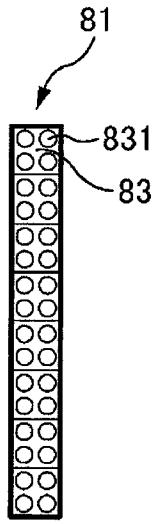
FIG. 7 is an explanatory drawing of the substrate of a first LED substrate 82A of an LED substrate assembly in a temporary curing unit 80.

FIG. 7 is an explanatory drawing of the LED substrate in the temporary curing unit 80. The LED substrate 81 includes a plurality of LED assemblies 83. In the present embodiment, two LED assemblies 83 are aligned in the width direction of the medium, and eight LED assemblies 83 are aligned in the conveying direction (constituting a total of 16 LED assemblies 83). One LED assembly 83 contains four LEDs 831. In the present embodiment, the LEDs used for the LEDs 831 have peak wavelengths at 385 to 405 nm.

The amount of electric current supplied to these LEDs can be adjusted and the radiation energy can be varied. In the present embodiment, the electric current is adjusted so that the pinning energy (temporary curing energy) is 5 to 30 $mJ/cm^2$/pass. The term "1 pass" herein refers to the action of the head moving once from one end to the other in the movement direction.

The main curing unit 90 is configured so that a plurality of LED substrates 81 are aligned in the head movement direction. The main curing unit 90 is mounted downstream of the second head 41B and is moved simultaneously due to the second head 41B moving in the head movement direction. Thus, since the main curing unit 90 is provided downstream from the second head 41B, the ink ejected by the first head 41A and temporarily cured and the ink ejected by the second head 41B and temporarily cured can undergo main curing by the main curing unit 90.

Figure 8:
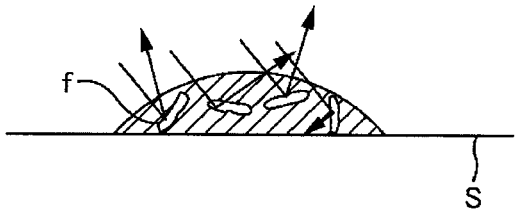
FIG. 8 is a drawing used to illustrate the reflection of light by metal foil fragments f in a dot.

FIG. 8 is a drawing used to illustrate the reflection of light by the metal foil fragments f in a dot.

The ultraviolet curable metallic ink ejected from a nozzle onto the medium forms a dot by being deposited on the medium. The metallic ink contains aluminum flakes or other tiny metal foil fragments f as a pigment. In the recording surface formed by ejecting this liquid, the metal pigment reflects light, whereby a metallic glossiness can be achieved in the recording surface.

The metal pigment is dispersed and distributed in irregular positions and directions within the dot formed on the medium, as shown in FIG. 8. When light is radiated and the dot is cured in this state, the metal pigment is fixed in its dispersed state within the dot. However, since the metal pigment is distributed in irregular orientations within the dot, the reflected light is also reflected in irregular directions, and the metallic glossiness will not have satisfactory texture.

In the present embodiment, the metal pigments can be made to lie flat within the dot, and the reflected light can be reflected in a uniform direction as much as is possible, as shown hereinbelow. In this manner, the texture of the metallic glossiness can be improved.

Figure 9:
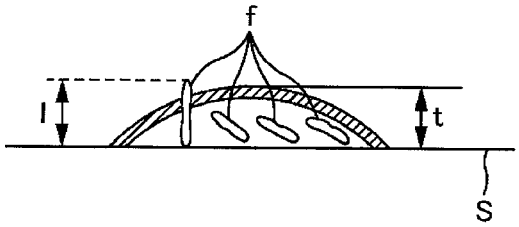
FIG. 9 is a drawing used to illustrate the relationship between the length of the long side of the metal foil fragment f and the ink film thickness.

FIG. 9 is a drawing used to illustrate the relationship between the length of the long sides of the metal foil fragments f and the ink film thickness. The drawing shows a dot formed by the metallic ink deposited on the medium. The metal foil fragments f included in the metallic ink are also shown. The average length of the long sides of the metal foil fragments f in the present embodiment is 1 to 2 μm, and the average thickness is 20 to 30 nm. The film thickness of the metallic ink is 1 μm or less.

In the present embodiment, the film thickness of the metallic ink can be adjusted by the energy and radiation timing of the light radiated onto the metallic ink. For example, if the metallic ink is irradiated with light immediately after being deposited on the medium, the metallic ink is cured in the state immediately after being deposited on the medium. If the metallic ink is irradiated with light after a predetermined amount of time has passed following deposition on the medium, the metallic ink spreads out over the medium until it is cured. As a result, the ink film will be thinner. FIG. 9 shows the manner in which the ink film thickness is at least equal to or less than the length of the long sides of the metal foil fragments f after temporary curing or main curing. Thus, if the ink film thickness is at least equal to or less than the length of the long sides of the metal foil fragments f, the metal foil fragments f will naturally lie flat so as to be parallel with the medium. The flattened metal foil fragments f reflect light in a substantially uniform direction, and the glossiness can therefore be improved.

FIGS. 10A through 10F are drawings showing the manner in which a dot is formed so that the ink film thickness is equal to or less than the length of the long sides of the metal foil fragments f.

Figure 10A:
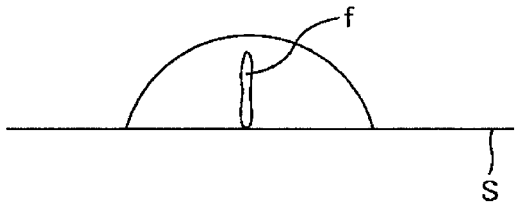
FIGS. 10A through 10F are drawings showing the manner in which a dot is formed so that the ink film thickness is equal to or less than the length of a long side of a metal foil fragment f.

FIG. 10A shows the state immediately after the metallic ink has been deposited on the medium S. For the sake of simplicity in the description, only one metal foil fragment f is shown in one dot. Immediately after being deposited, the deposited metallic ink has not yet spread out. Therefore, even if the metal foil fragment f stands perpendicular to the medium, the ink film thickness is not equal to or less than the length of the long side of the metal foil fragment f. At this point in time, either the metallic ink has not yet been irradiated by ultraviolet rays, or it has been temporarily irradiated but only in a small amount insufficient to affect the movement of the metal foil fragment f.

Figure 10B:
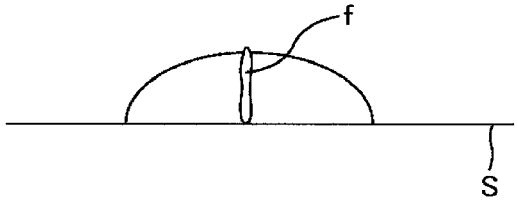

With the passage of a predetermined amount of time, the metallic ink on the medium then spreads out. As a result, the ink film thickness becomes equal to or less than the length of the long side of the metal foil fragment f as shown in FIG. 10B.

Figure 10C:
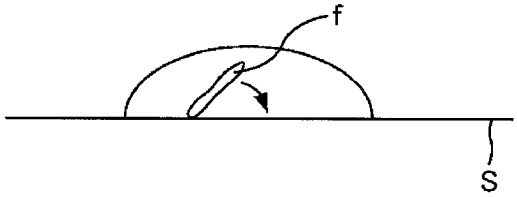
Figure 10D:
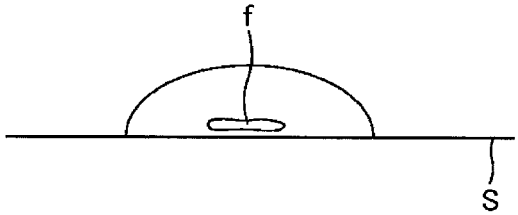

Furthermore, assuming the metallic ink will not be irradiated with ultraviolet rays, the upright metal foil fragment f will lie flat on the medium. FIG. 10C shows a metal foil fragment f in the act of lying flat on the medium. The metal foil fragment f then lies flat on the medium S (FIG. 10D).

Figure 10E:
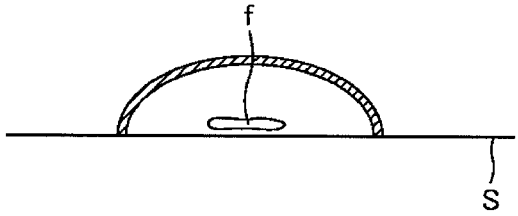

After the metal foil fragment f has come to lie flat on the metal foil fragment f, ultraviolet rays for temporary curing are irradiated. The surface of the metallic ink is then cured, and the ink film thickness is substantially fixed at its thickness at this point in time (FIG. 10E). The timing with which the ultraviolet rays for temporary curing are irradiated may be the timing in FIG. 10C. This is because when ultraviolet rays for temporary curing are irradiated, the ink surface is cured but the interior is not cured, and the metal foil fragment f therefore continues move toward lying flat on the medium S.

Figure 10F:
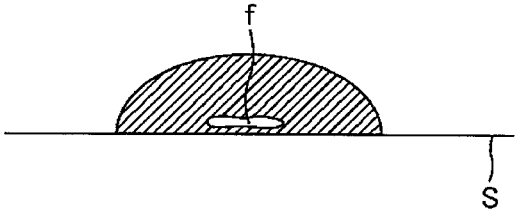

Last, the ultraviolet rays for main curing are irradiated, and the ink is cured (FIG. 10F). Thus, after the metal foil fragment f has been made to lie flat while being substantially parallel with the medium, the ink is cured, light reflected by the metal foil fragment f is appropriately reflected to an observer, and the glossiness can be improved.

In the embodiment previously described, the timing by which the metallic ink on the medium spread out was adjusted by controlling the timing of radiating light. The ink film thickness was controlled so as to be equal to or less than the length of the long side of the metal fragment f, but the control of ink film thickness is not limited to this method. For example, the ink film thickness may be controlled by adjusting the radiation intensity of temporary curing light. Specifically, a method may be used in which the light radiation intensity is reduced immediately after the metallic ink is deposited, the metallic ink is allowed to spread out, and the intensity is thereafter gradually increased.

In the embodiment previously described, a so-called serial inkjet printer whose heads move in a movement direction was described as an example, but the present invention is not limited thereto. For example, the present invention may be embodied as a so-called line inkjet printer in which the heads are fixed and an image is formed by ink being ejected onto a conveyed medium. In this case, the heads, which discharge metallic ink or white ink as a background color, are disposed farthest upstream in the conveying direction of the medium. A radiation device for temporary curing is disposed downstream of the heads, and downstream of this radiation device are disposed heads for yellow Y, magenta M, cyan C, black K, and other color inks, as well as another radiation device for temporary curing. A radiation device for main curing is disposed farthest downstream. At this time, the head for ejecting metallic ink and the radiation device for temporarily curing the metallic ink are disposed separated from each other by a predetermined distance in the conveying direction. This makes it possible to achieve a time duration in which the metallic ink spreads out so that the ink is temporarily cured after the ink film thickness has decreased equal to or less than the length of the long sides of the metal foil fragments.

Other Embodiments

In the embodiment described above, the printer 1 was described as the printing device, but the printing device is not limited to this printer and can be embodied as a liquid discharge device which ejects or discharges a fluid other than ink (a liquid, a liquid-like substance in which particles of a functional material are dispersed, or a fluid such as a gel). For example, the above-described embodiment and similar technologies may be applied to various devices which apply inkjet technology, such as color filter manufacturing devices, dyeing devices, micromachining devices, semiconductor manufacturing devices, surface treatment devices, three-dimensional molding devices, gas vaporizer devices, organic EL manufacturing devices (particularly macromolecular EL manufacturing devices), display manufacturing devices, film-forming devices, and DNA chip manufacturing devices, for example. The methods and manufacturing methods of these devices are also categorized in the applicable range.

The embodiment described above is intended to make the present invention easier to understand, and should not be interpreted as limiting the invention. The present invention can be modified and improved without deviating from the scope of the invention, and all equivalents thereof are included in the present invention, as shall be apparent.

Heads

In the embodiment described above, ink was discharged using piezoelectric elements. However, the system for discharging the liquid is not limited to this example. For example, a system which creates bubbles in the nozzles by heat or another system may be used.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a head configured to eject metallic ink including a plurality of longitudinally elongated metal fragments onto a medium, the longitudinally elongated metal fragments having a long side length;

a radiation unit configured to irradiate the metallic ink with light to cure the metallic ink; and a control unit configured to control irradiation of the light by the radiation unit so that a film thickness formed by the metallic ink is equal to or less than the long side length of the longitudinally elongated metal fragments when the metallic ink is cured on the medium.

2. The printing device according to claim 1, wherein the control unit is configured to control the radiation unit to irradiate the light onto the metallic ink deposited on the medium after a predetermined amount of time after the metallic ink has been ejected onto the medium so that the film thickness formed by the metallic ink is made equal to or less than the long side length of the longitudinally elongated metal fragments.

3. The printing device according to claim 1, wherein the control unit is configured to control the radiation unit to adjust an intensity of the light irradiated onto the medium so that the film thickness formed by the metallic ink is made equal to or less than the long side length of the longitudinally elongated metal fragments.

4. The printing device according to claim 1, wherein the metallic ink is an ultraviolet-curable liquid and the light includes ultraviolet rays.

5. The printing device according to claim 1, further comprising a nozzle configured to eject drawing ink for forming an image, the drawing ink for forming the image being ejected onto the metallic ink after the metallic ink has been cured so that the film thickness formed by the metallic ink is equal to or less than the long side length of the longitudinally elongated metal fragments.

6. The printing device according to claim 1, wherein the long side length of the longitudinally elongated metal fragments is an average of lengths of the longitudinally elongated metal fragments included in the metallic ink.

7. The printing device according to claim 1, wherein the film thickness is an average of film thicknesses formed on the medium by the metallic ink.

8. The printing device according to claim 1, wherein each of the longitudinally elongated metal fragments is a longitudinally elongated foil.

9. A printing method comprising:

ejecting metallic ink including a plurality of longitudinally elongated metal fragments from a head onto a medium, the longitudinally elongated metal fragments having a long side length; and irradiating the metallic ink with light to cure the metallic ink so that a film thickness formed by the metallic ink is equal to or less than the long side length of the longitudinally elongated metal fragments when the metallic ink is cured on the medium.

10. The printing method according to claim 9, wherein the irradiating of the metallic ink includes irradiating the light onto the metallic ink deposited on the medium after a predetermined amount of time after the metallic ink has been ejected onto the medium so that the film thickness formed by the metallic ink is made equal to or less than the long side length of the longitudinally elongated metal fragments.

11. The printing method according to claim 9, wherein the irradiating of the metallic ink includes adjusting an intensity of the light irradiated onto the medium so that the film thickness formed by the metallic ink is made equal to or less than the long side length of the longitudinally elongated metal fragments.

12. The printing method according to claim 9, wherein the metallic ink is an ultraviolet-curable liquid and the light includes ultraviolet rays.

13. The printing method according to claim 9, further comprising ejecting drawing ink for forming an image onto the metallic ink after the metallic ink has been cured so that the film thickness formed by the metallic ink is equal to or less than the long side length of the longitudinally elongated metal fragments.

14. The printing method according to claim 9, wherein the long side length of the longitudinally elongated metal fragments is an average of lengths of the longitudinally elongated metal fragments included in the metallic ink.

15. The printing method according to claim 9, wherein the film thickness is an average of film thicknesses formed on the medium by the metallic ink.

16. The printing method according to claim 9, wherein each of the longitudinally elongated metal fragments is a longitudinally elongated foil.

* * * * *